United States Patent [19]

Bluemle

[11] Patent Number: 5,006,037

[45] Date of Patent: Apr. 9, 1991

[54] APPARATUS FOR TURNING OVER CARTONS

[75] Inventor: Martin Bluemle, Horhausen, Fed. Rep. of Germany

[73] Assignee: Winkler & Duennebier Maschinenfabrik und Eisengiesserei KG, Neuwied, Fed. Rep. of Germany

[21] Appl. No.: 338,303

[22] Filed: Apr. 14, 1989

Related U.S. Application Data

[63] Continuation-in-part of Ser. No. 189,629, May 3, 1988, Pat. No. 4,870,803.

[30] Foreign Application Priority Data

May 7, 1987 [DE] Fed. Rep. of Germany ..... 3715191

[51] Int. Cl.[5] ..... B65G 47/252

[52] U.S. Cl. ..... 414/771; 198/403; 414/769

[58] Field of Search ..... 414/759, 769, 771, 773; 198/403

[56] References Cited

U.S. PATENT DOCUMENTS 3,562,775 2/1971 Mullins .

FOREIGN PATENT DOCUMENTS 1303647 4/1973 Fed. Rep. of Germany ..... 414/771
8632668 1/1988 Fed. Rep. of Germany .
2578522 9/1986 France .
2099345 12/1982 United Kingdom .

*Primary Examiner*—Robert J. Spar
*Assistant Examiner*—Janice Krizek
*Attorney, Agent, or Firm*—W. G. Fasse; D. H. Kane, Jr.

[57] ABSTRACT

An apparatus for turning bodies such as cardboard boxes or cartons or the like, especially for use in a machine for packing envelopes into cartons, includes at least one bottom carrier which is tiltably driven about a horizontal axis, and at least one top carrier which may be tilted on top of the body to be turned over. At least one connecting member and journalling elements connect the two carriers with each other in such a manner that both carriers can be tilted together or in unison and so that one carrier can also be tilted independently of the other carrier by a respective drive or tilting member. At least one carton supporting lip protrudes from at least one of the carriers for holding the carton while it is being turned.

8 Claims, 6 Drawing Sheets

APPARATUS FOR TURNING OVER CARTONS

CROSS-REFERENCE TO RELATED APPLICATION

The present application is a new continuation-in-part application of my copending application U.S. Ser. No. 189,629; filed on May 3, 1988, now U.S. Pat. No. 4,870,803, issued on Oct. 3, 1989.

FIELD OF THE INVENTION

The invention relates to an apparatus for turning over bodies such as cartons or cardboard boxes, especially in a machine for packing envelopes into cartons.

BACKGROUND INFORMATION

Machines for packing envelopes are known. For example, U.S. Pat. No. 3,562,775 (Mullins) discloses such an apparatus in which cartons or cardboard boxes are placed from above onto standing stacked envelopes. The cartons, with their contents, then slide downwardly along an inclined plane and are braked against a stop in such a manner that they tip over and finally come to rest on a conveyor belt with the floor or bottom of the carton facing downwardly and the opening of the carton facing upwardly. In the prior art apparatus, the cartons are supplied in a direction perpendicular to the transport direction of the envelopes which are standing in stacks, and the cartons along with their content envelopes are further transported along the inclined plane to the conveyor belt in a direction perpendicular to or across the original transport direction of the envelopes. Such an arrangement or apparatus requires that sufficient space is available for the perpendicularly directed transport of the empty and the full cartons. Often, however, the required space is not available.

OBJECTS OF THE INVENTION

In view of the above it is the aim of the invention to achieve the following objects singly or in combination:

to provide an apparatus for turning over a body such as a cardboard carton by 180°, especially for use in a machine for packing envelopes into cardboard cartons, wherein, prior to the turning the carton has been pushed from above and will not spill the envelopes over which the carton has been placed from above;

to construct such an apparatus so that a body such as a cardboard carton may be turned over in a short distance so that the apparatus requires only a small space for operating;

to transport a body, such as a cardboard carton, in the same direction as the initial transport direction of the contents of the carton, such as a stack of envelopes, during the turning over of the cardboard carton, in other words, the turning over shall take place in the transport direction; and to make sure that after the turning the open end of the carton with its open end closure flap faces upwardly with the contents safely in the carton without spilling.

SUMMARY OF THE INVENTION

The above objects have been achieved in an apparatus for turning over cartons according to the invention, comprising at least one driven first carrier arranged to be tiltable about a horizontal axis on the bottom side of a carton to be turned over, and at least one second tiltable carrier which can be placed on top of the body or carton. The apparatus further includes at least one connecting means or intermediate member connecting the bottom and top carriers to each other, and at least one supporting member protruding from at least one of the two carriers.

More specifically, the first or bottom carrier supports the carton or body to be turned over from below, while the other second or top carrier is placed onto or supports the carton from above. Then both carriers are tilted together so that the carrier which was originally positioned on the top is now positioned on the bottom. The two carriers are interconnected by at least one intermediate part or connecting rod which allows relative movements between the two carriers so that the two carriers may be opened sufficiently to permit grabbing the carton. The arrangement of the two carriers, or specifically, of the tilting axes of the two carriers, is preferably such that the turning operation is carried out in the transport direction of the stacked envelopes rather than perpendicular to the transport direction of the envelopes. However, both turning directions are basically possible, but turning in the transport direction is preferred since it saves space.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
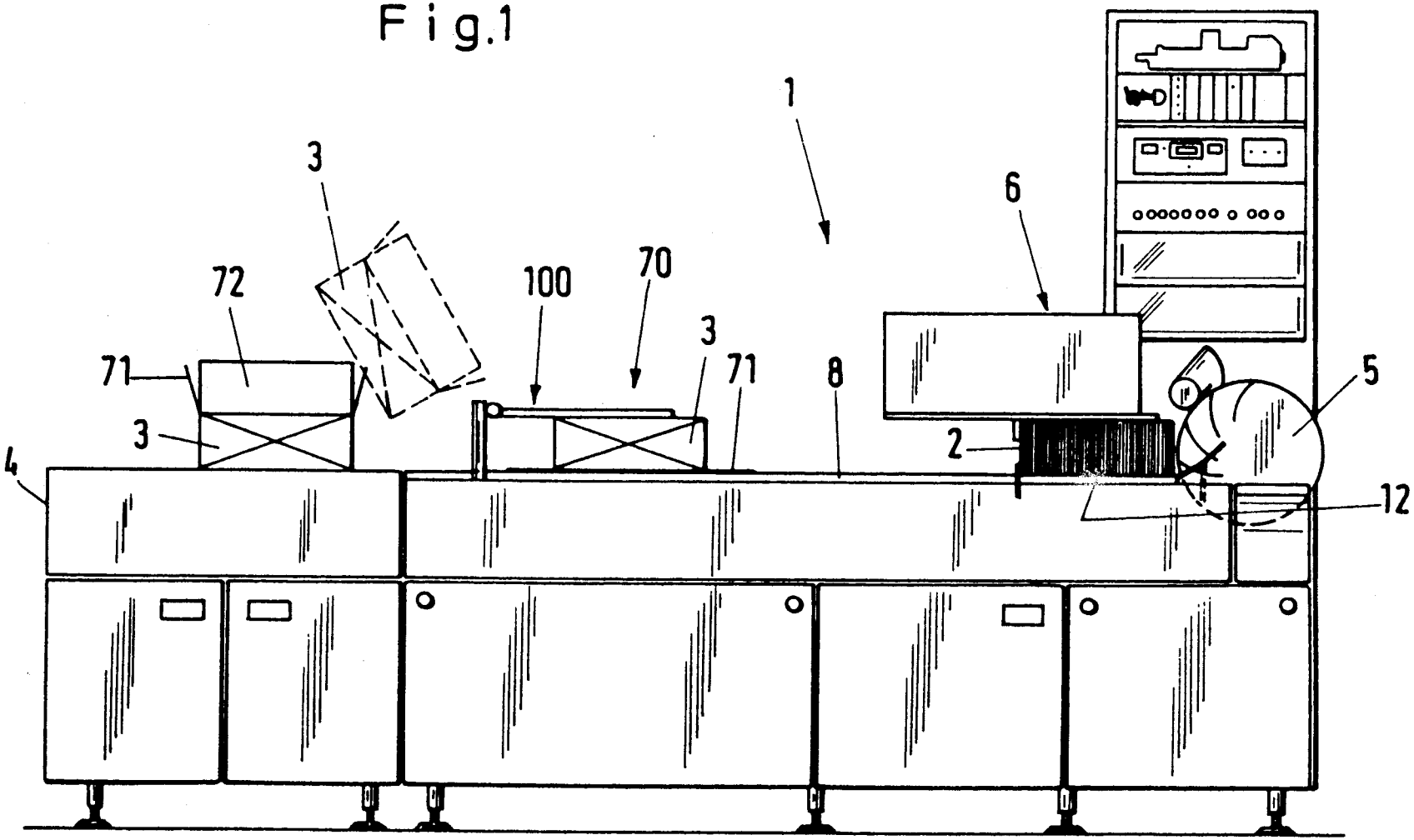
FIG. 1 is a schematic side view of a machine for packing envelopes into cartons, including an apparatus according to the invention for turning over the cartons.

As shown in FIG. 1, the present apparatus 1 for packing envelopes 2 into cartons 3 comprises a machine frame 4 and a laying-down or envelope depositing mechanism 5 for the initially individually delivered envelopes 2. The envelopes 2 which are delivered by the depositing apparatus 5 are first stacked horizontally on a stacking stage 6, and from there are then pushed into a boxing or turning station 70, in a manner which is not of direct interest here. In the boxing and turning station 70, the envelopes 2 are packed into cartons 3 which are then turned over. The packing or boxing is achieved manually or by means of a robot which is not shown in FIG. 1. In any event, the cartons 3 are pushed onto the stacks 12 of envelopes 2, which have been pushed into the appropriate position in the boxing and turning station 70. Then, the filled cartons 3 are displaced in a direction extending in the movement direction of the stack 12 by means of a turning device 100, in such a manner that the cartons 3, which were previously oriented with their opening downwardly, are turned over by 180° so that their openings and their closing flaps 71, 72 face upwardly as shown in the left portion of FIG. 1.

Figure 2:
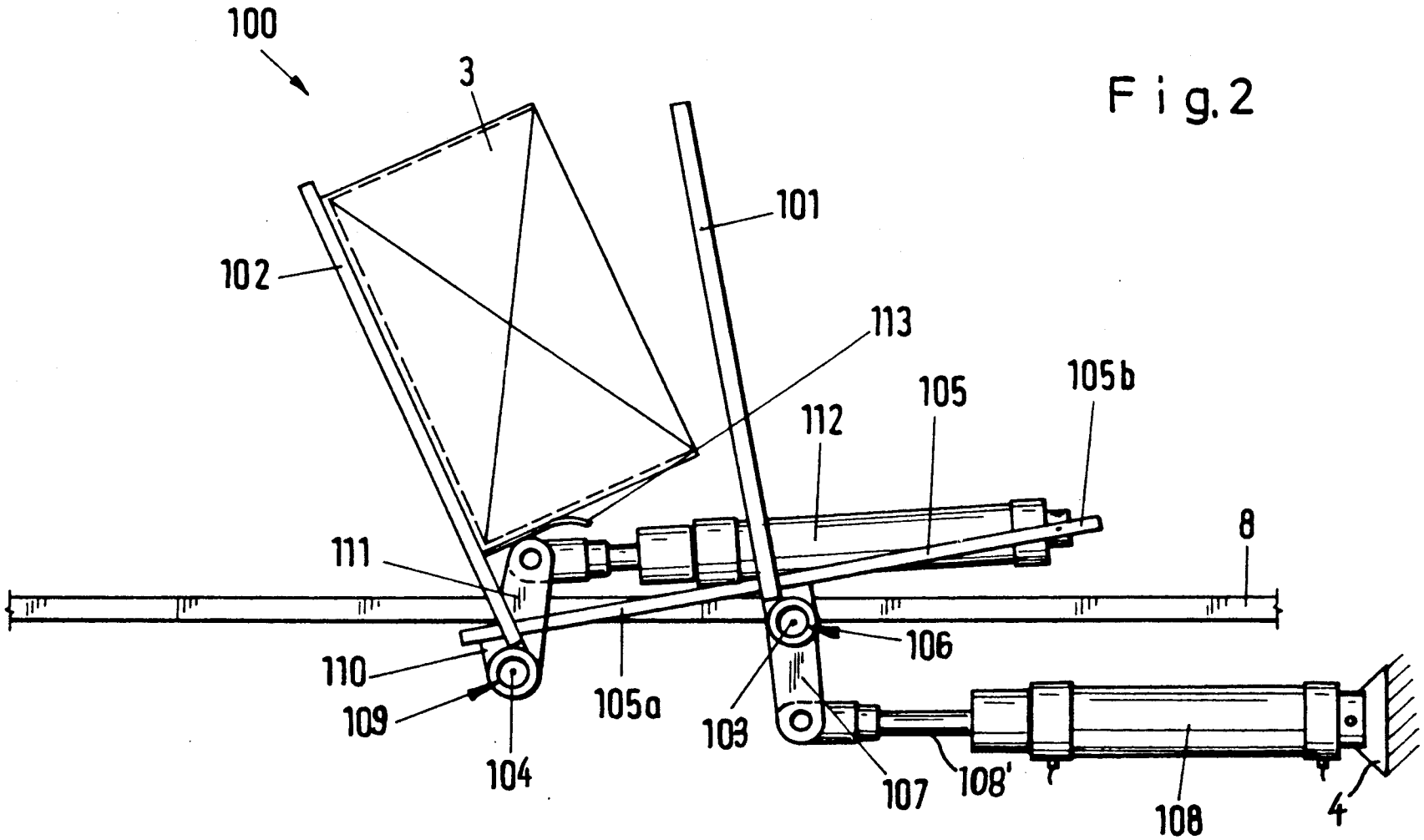
FIG. 2 is a detailed side view of the turning apparatus during a turning procedure.
Figure 3:
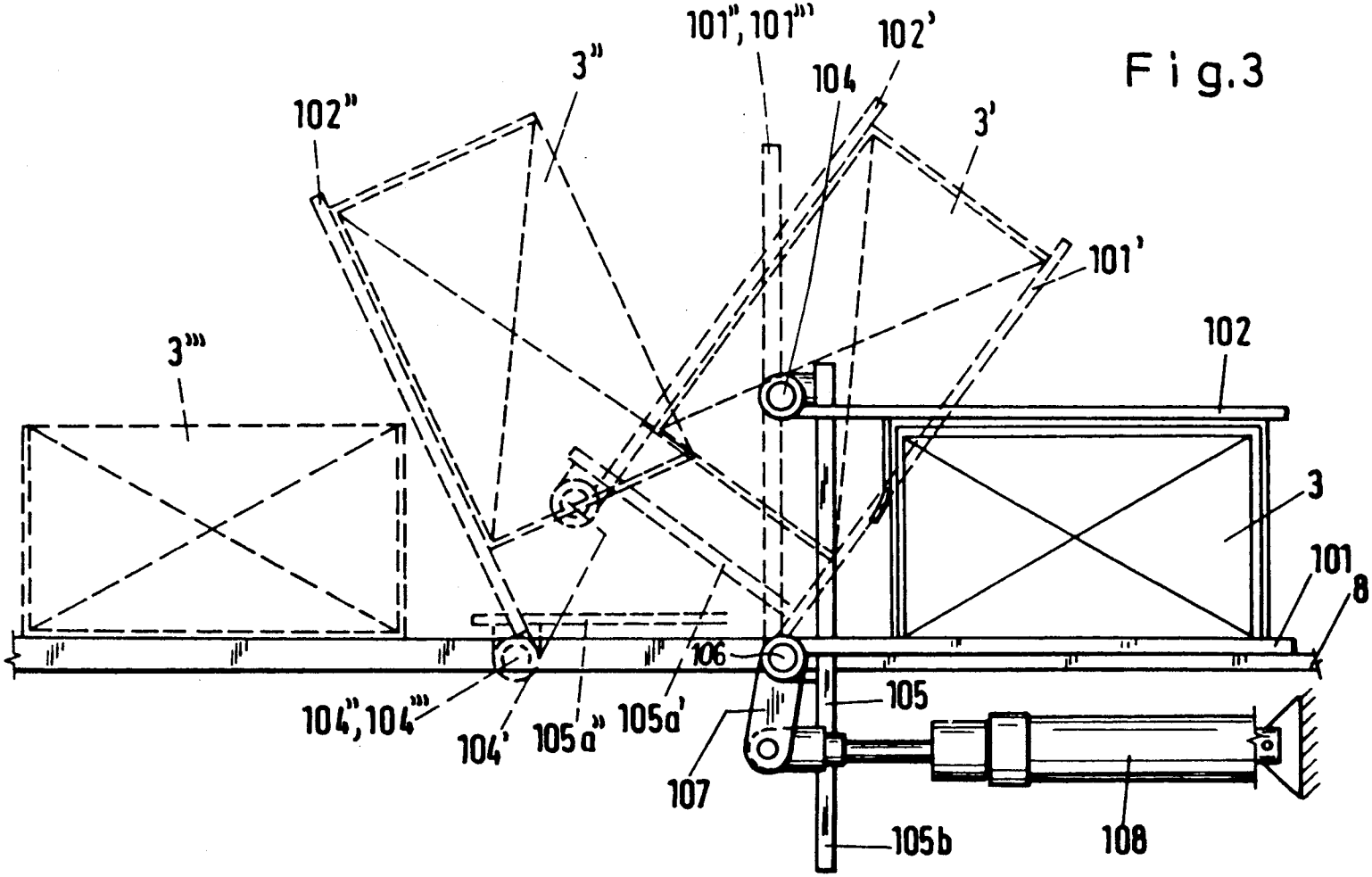
FIG. 3 is a detailed side view of the turning apparatus showing several stages in the turning procedure by dashed lines.
Figure 4:
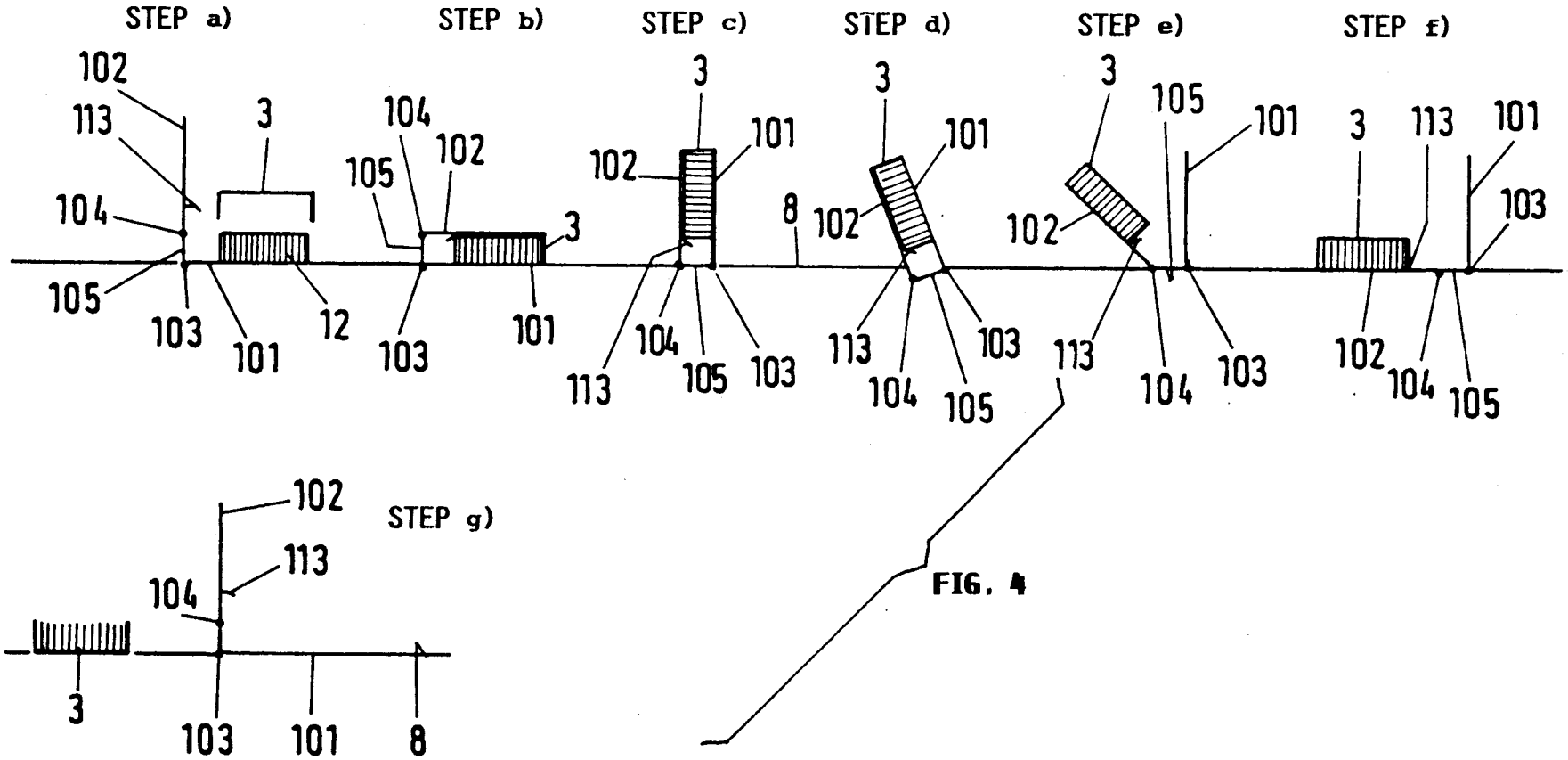
FIG. 4 is a schematic representation of the several stages in a turning procedure shown by steps (a) to (g)

Details of the turning device 100, which preferably works in the direction of movement of the stack 12 coming from the stacking stage 6 are shown in FIGS. 2 and 3. FIG. 4 shows the individual steps of a turn over cycle.

As shown in FIG. 2, the turning apparatus 100 comprises two, for example fork-shaped, first and second carriers 101 and 102 arranged at a spacing from one another and adjustable relative to one another. Both carriers 101 and 102 are tiltably arranged about a first horizontal axis 103 relative to a table plate 8, in the apparatus 1. For this purpose a support 105 tilts about the first horizontal axis 103. Both carriers 101 and 102 are secured to the support 105 for tilting in unison. Additionally, the second carrier 102 is tiltable independently of the tilting in unison.

For such independent tilting, the fork-shaped second carrier 102 is independently rotationally supported on the support 105 by a second horizontal axis 104 for tilting relative to the support 105 which forms an intermediate connecting member 105 between the first carrier 101, which is rigidly connected to the intermediate member 105, and mounting members 109, 110, which mount the second carrier 102 in a tiltable manner to the intermediate member 105 at said second horizontal axis 104. The intermediate connecting member 105 has two arms 105*a* and 105*b*. The fork-shaped first carrier 101 is rigidly connected at a right angle to the intermediate connecting member 105 to form a rigid unit 101, 105. A rotatable shaft 106 is arranged coaxially on the axis 103, and is supported by bearings which are not shown, to rotate relative to the table 8. The connecting member 105 is rotationally rigidly attached to the shaft 106. Alternatively, the shaft 106 may be fixed against rotation and the connecting member 105 may be rotatably supported on the fixed shaft 106 by appropriate bearings. A piston cylinder device 108, for example in the form of a pneumatic piston cylinder 108, pivoted to a lever 107, acts on the rotatable shaft 106 through the lever 107, whereby the piston rod 108' of the cylinder 108 tilts the connecting member 105 so that both fork-shaped carriers 101 and 102 are tilted in unison. The piston cylinder 108 itself is tiltably supported in the machine frame 4 as shown. Alternatively, if the shaft 106 is fixed, the lever 107 may act directly on the connecting member 105 to see-saw about the fixed shaft 106.

The fork-shaped carrier 102 is rotationally rigidly attached to a shaft 109 arranged on the axis 104. This shaft 109 is rotationally arranged or supported in the bearing bracket 110 which is rigidly connected to the free end of one arm 105*a* of the intermediate member 105. A lever 111 is rotationally rigidly connected to the shaft 109 and is journalled to a further piston cylinder device 112 in the form of a pneumatic cylinder 112, which is similarly tiltably supported at the free end of the arm 105*b* of the intermediate member 105. The piston cylinder device 112 tilts together with the member 105 and operates the fork-shaped second carrier 102 to tilt about the axis 104 of the shaft 109 relative to the first fork-shaped carrier 101 or to the arm 105*a* extending perpendicularly to the first carrier 101. The fork-shaped carrier 102 is further provided with a supporting bracket 113 or holding plate 113 which has a bent free end and which supports a full carton 3 during the turning phase.

The two arms 105*a* and 105*b* of the intermediate member 105 have approximately equal lengths and form approximately an inverted T-shape with the fork-shaped carrier 101 as seen in FIG. 2. The lever 107 forms substantially an extension of the fork-shaped carrier 101, whereby the axis 103 is arranged in such a manner in or under the table plate 8 that, according to a preferred embodiment, the fork-shaped carrier 101 may lie in the plane of the table 8 or in parallel thereto when a carton is to be grabbed as shown in steps a and b of FIG. 4, for example.

Various stages of the tilting or turning operation are shown in FIG. 3, whereby the same parts respectively have the same reference numbers. The steps a to g corresponding to the different positions of the carriers 101 and 102 in FIG. 4 illustrate, in a rather abstract manner, the motion cycle of the turning apparatus 100.

According to step a in FIG. 4 a stack 12 is standing in the boxing position. The fork-shaped carrier 101 is located in the plane of the table plate 8 below the stack 12. The carrier 102 is tilted by 90° upwardly into a vertical position. The axis 104 is located vertically above the axis 103, whereby the connecting member 105 is located substantially under the stack 12 by the action of the piston cylinder device 108 which has tilted the lever 107 through about 90° in the clockwise direction from the view of FIG. 2.

According to step b in FIG. 4, a carton 3 has been placed upside down over the stack 12. The carrier 101 still lies in the plane of the table plate 8. The carrier 102 is tilted onto the carton 3 and lies parallel to the carrier 101. This is accomplished by the operation of the second piston cylinder device 112 shown in FIG. 2. The axis 104 remains vertically above the axis 103. The carton 3 with the stack 12 is now located between the two carriers 101 and 102, and the supporting or holding plate 113 contacts the carton 3 laterally at the upper left corner of the carton as seen in step b of FIG. 4. The intermediate connecting member 105 or rather its one arm 105*a* defines the spacing between the two carriers 101 and 102 lying parallel to one another in steps b, c, and d.

According to step c in FIG. 4, the filled carton 3 is tilted upwardly by 90° by the operation of the first piston cylinder device 108, whereby the holding plate 113 supports the carton 3 from below. The two fork-shaped carriers 101 and 102 extend upwardly in parallel and at 90° to the plane of the table plate 8. The axis 104 is tilted into the plane of the table plate 8 by the piston cylinder device 108.

According to step d in FIG. 4, the carton 3 with its contents is located in a position of approximately 120° relative to the view of step a in FIG. 4. The two fork-shaped carriers 101 and 102 still extend in parallel to one another. The axis 104 is now located below the plane of the table plate 8.

According to step e of FIG. 4, the fork-shaped carrier 101 is tilted back into a position perpendicular to the plane of the table plate 8, whereby the intermediate connecting member arm 105*a* rigidly connected to the carrier 101 has again been lifted in the clockwise direction and the axis 104 now lies in the plane of the table plate 8. The carton 3 with its contents is carried by the fork-shaped carrier 102 and the support plate 113.

According to step f in FIG. 4, the fork-shaped carrier 101 is still standing perpendicularly to the plane of the table plate 8. The fork-shaped carrier 102 has moved the carton 3 and its contents, so that the opening of the carton is facing upwardly, and the carton is now in a horizontal plane. The carrier 102 may place the carton onto a further transporting conveyor belt, or the like, not shown. The axis 104 still lies in the plane of the table plate 8.

According to the last step g in FIG. 4, the carriers 101 and 102 have been tilted back into their initial starting position as in step a in FIG. 4, whereby the carrier 101 lies in the plane of the table plate 8 and the carrier 102 stands perpendicularly to the plane of the table plate 8. The axis 104 is again located vertically above the axis 103.

The entire motion cycle rs achieved by means of a respectively appropriately timed control of the two piston cylinder devices 108 and 112, whereby a carton 3 is turned over as described from a position facing with its opening downwardly on top of a stack 12 into a position with its opening facing upwardly, whereby the motion may entail 180° as shown, or more or less than 180°. For turning over stacks 12, or cartons 3 with contents, or any desired body, the turning apparatus 100 makes sure that the tiltable carrier 101 is arranged on the bottom side in the initial starting position while the second carrier 102, which is tiltable in unison with the carrier 101 or independently thereof, may be placed on top of the body or carton 3.

FIG. 3 is a view similar to that of FIG. 2, but showing in addition to the solid line position, three additional positions in dashed lines. The second tilting mechanism 112 is not shown in FIG. 3. The full line illustration in FIG. 3 corresponds to step b in FIG. 4. To reach the first dashed line position 3', 101', 102', 104' and **105*a*' in a counterclockwise turning movement, the first tilting mechanism 108 is activated until the carriers extend at the desired angle relative to the horizontal. The first tilting mechanism 108 tilts both carriers 101 and 102 in unison. The first dashed line position corresponds to a movement toward step c or position c in FIG. 4. The second dashed line position 3'', 101'', 102'', 104'' and 105*a*'' corresponds to step e or position e in FIG. 4 and is reached by activating the second tilting mechanism 112 shown in FIG. 2. The last dashed line position 3''', 101''', 102'*f*, and 104''' corresponds to step f or position f in FIG. 4. The second tilting mechanism 112 turns the carrier 102 independently of the carrier 101**.

Figure 5:
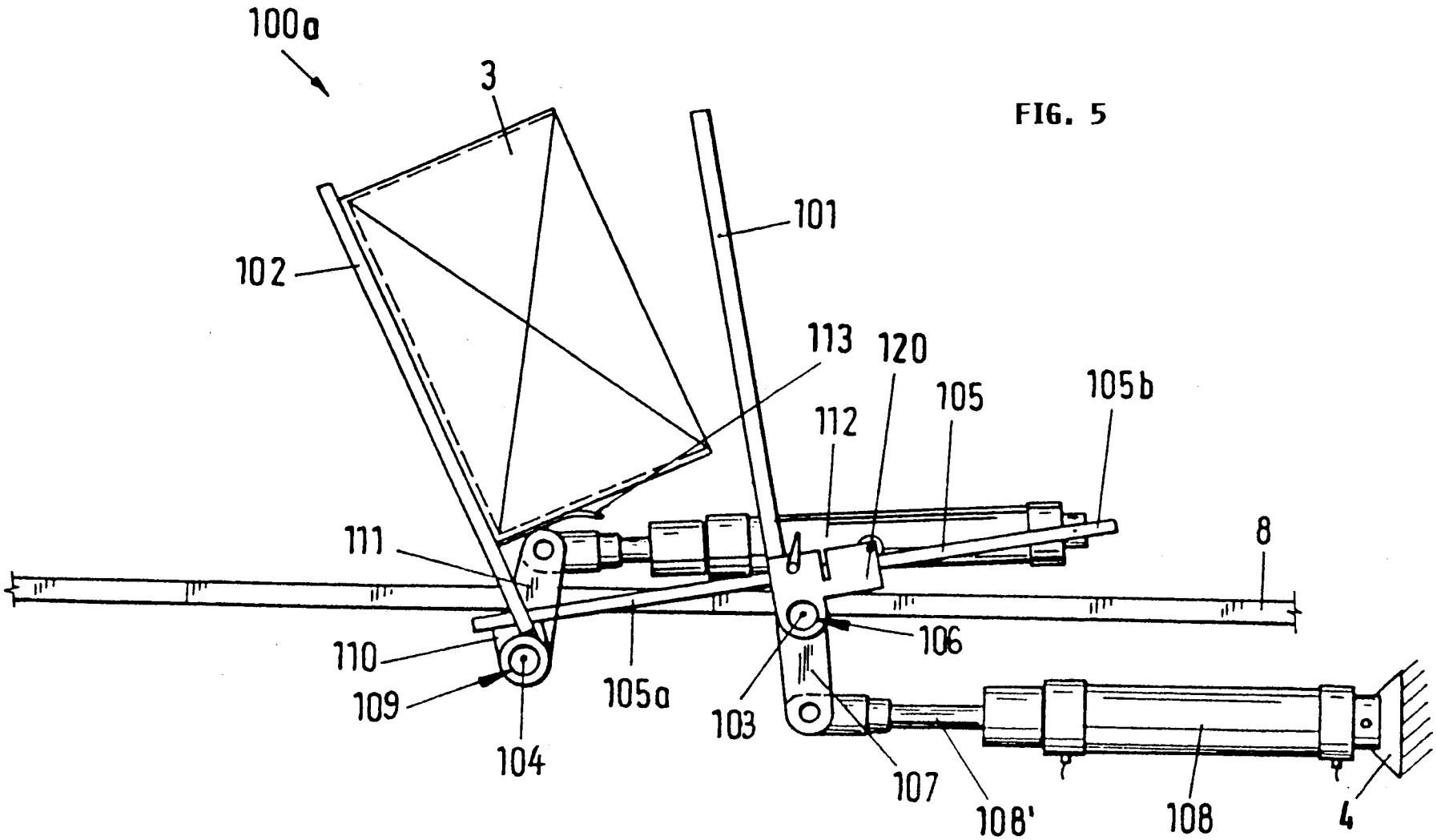
FIG. 5 is a detailed side view similar to that of FIG. 2, but of an alternative embodiment of a turning apparatus.
Figure 6:
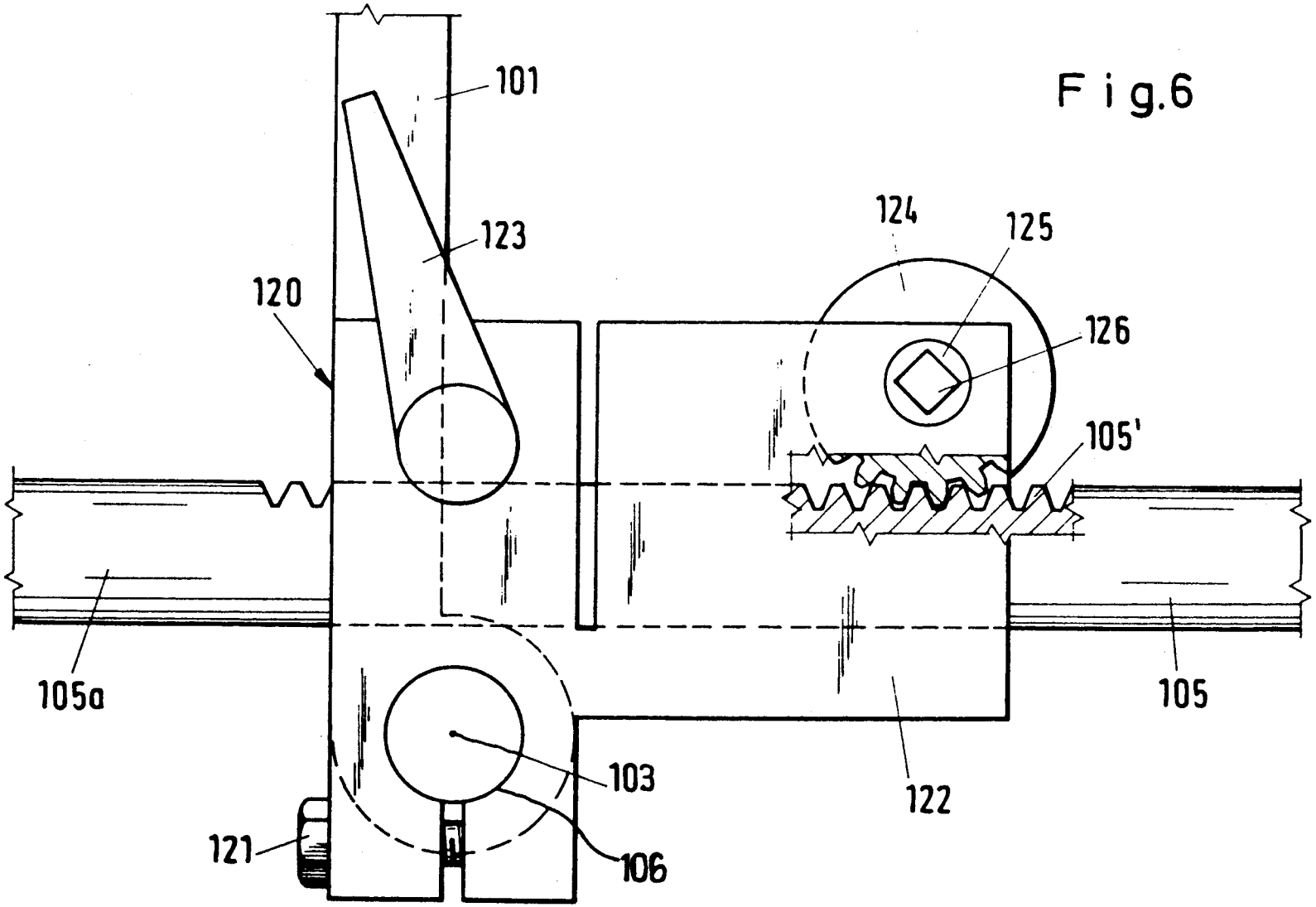
FIG. 6 is an enlarged detailed view of a portion of the turning apparatus of FIG. 5.

FIG. 5 is similar to FIG. 2, but shows an alternative embodiment of a turning apparatus **100*a*. FIG. 6 shows a detail of the turning apparatus 100*a* and will be discussed simultaneously with FIG. 5. The turning apparatus 100*a* comprises fork-shaped carriers 101 and 102 which may be tilted in unison or relative to one another as described above with reference to FIG. 2, but which may also be adjusted in their relative spacing. That is to say, the spacing distance between the carrier 101 and the carrier 102 may be adjusted so that the turning apparatus 100*a* may be used to turn over cartons 3** of varying sizes.

Components of the turning apparatus **100*a* which correspond to the components of the turning apparatus 100 as shown in FIG. 2 have the same reference numbers and will not be described again in detail. As described above with reference to FIG. 2, a shaft 106 is rotatably supported in a machine frame 4. The lever 107 is rotationally rigidly attached to the rotatable shaft 106. However, unlike the arrangement of the turning apparatus 100 shown in FIG. 2, the turning apparatus 100*a* comprises a clamping bracket 120 which is rotationally rigidly attached to the shaft 106 by means of a clamping screw 121 as shown particularly in FIG. 6. The clamping bracket 120 carries the connecting member 105 and attaches the connecting member 105 to the shaft 106. Preferably, two clamping brackets 120 are arranged laterally next to each other, that is to say, one behind the other in the view of FIG. 5, whereby these two clamping brackets 120 carry two intermediate connecting members 105 arranged in parallel and at a spacing relative to each other. The fork-shaped carrier 101 is similarly rotationally rigidly attached to the shaft 106 between the two clamping brackets 120**.

As shown in detail in FIG. 6, a bored hole 122 passes through each clamping bracket 120 at a right angle relative to the shaft 106 and relative to the fork-shaped carrier 101. The respective intermediate connecting member 105 is slideably guided in the lengthwise bored hole 122. A clamping lever 123 is provided to lock the connecting member 105 into a desired position. Preferably, both the connecting member 105 and the bored hole 122 each have a circular cross-section. In an area representing a range of adjustment motion near the clamping bracket 120, the connecting member 105 comprises a linear gearing 105' which engages a gear wheel 124. The gear wheel 124 is rotationally rigidly attached to a bolt 125 which is rotatably supported in the clamping bracket 120.

In order to adjust the axial position of the connecting member 105 and thereby to adjust the spacing between the carrier 101 and the carrier 102, the clamping lever 123 is loosened and the gear wheel 124 is turned, for example, by means of a wrench applied to a four-sided bolt head 126 of the bolt 125. Appropriately turning the gear wheel 124 achieves a desired axial sliding of the connecting member 105 via the gear wheel 124 meshing with the linear gearing 105'.

In a preferred embodiment, two clamping brackets 120 and two connecting members 105 are provided, whereby each free end of each arm **105*a* of the two connecting members 105 carries a bearing 110 as shown in FIG. 5 and also in FIG. 2. The shaft 109 is rotatably supported in these bearings 110. The fork-shaped carrier 102 and the lever 111 are rotationally rigidly attached to the shaft 109. Respective opposite ends of the piston cylinder device 112 are journalled or pivotally attached respectively to the lever 111 and to the free end of the second arm 105*b* of each intermediate connecting member 105. The piston cylinder device 112 thereby moves in unison with the connecting member 105 so that when the connecting member 105 is axially adjusted by sliding in the clamping bracket 120, the piston cylinder device 112 is moved in unison with the connecting member 105** and requires no separate adjustment.

Although the invention has been described with reference to specific example embodiments, it will be appreciated that it is intended to cover all modifications and equivalents within the scope of the appended claims.

What I claim is:

1. An apparatus for turning a body (3), such as a carton, so that an initially downwardly facing side of said body faces in another direction when the turning is completed, comprising a machine frame (4), tiltable first carrier means (101) for contacting said body (3) on said downwardly facing side, first mounting means (103, 106) forming a first horizontal axis (103) for tiltably mounting said first carrier means (101) to said machine frame, tiltable second carrier means (102) for contacting another side of said body (3), intermediate connecting means (105) rigidly and nonpivotably attached to said first carrier means (101), whereby said first carrier means (101) and said intermediate connecting means (105) form a rigid unit (101, 105) which is tiltable about said first horizontal axis (103) formed by said first mounting means (103, 106), second mounting means (109, 110) forming a second horizontal axis (104) for tiltably mounting said second carrier means (102) to said intermediate connecting means (105), first tilting drive means (108) connected to said rigid unit (101, 105) for tilting both carrier means (101, 102) and said intermediate connecting means in unison about said first horizontal axis (103), and second tilting drive means (112) for tilting said second carrier means (102) about said second horizontal axis (104) independently of any tilting in unison by said first tilting drive means (108), whereby both drives participate in said turning.

2. The apparatus of claim 1, further comprising a body holding member (113) attached to said second carrier means (102), said holding member projecting from said second carrier means (102) for supporting said body (3)

3. The apparatus of claim 1, wherein said first carrier means (101) and said intermediate connecting means (105) are rigidly connected to each other at substantially a right angle to form approximately an inverted T-shape, and wherein said second mounting means (109, 110) journal said second carrier means (102) to a first free end (105*a*) of said intermediate connecting means (105).

4. The apparatus of claim 3, wherein said second tilting drive means (112) comprises a piston cylinder device (112) and means for articulately connecting said piston cylinder device (112) between a fixed point of said rigid unit and said second carrier means (102).

5. The apparatus of claim 4, wherein said intermediate connecting means (105) comprise a second free end (105*b*) which forms said fixed point to which one end of said piston cylinder device (112) is articulated, and wherein said second carrier means (102) comprise a lever arm (111) journalled to the other end of said piston cylinder device (12).

6. The apparatus of claim 1, comprising adjustment means for adjusting a spacing between said first carrier means (101) and said second carrier means (102).

7. The apparatus of claim 6, wherein said adjustment means comprises a clamping bracket for adjustably rigidly interconnecting said intermediate connecting means (105) and said first carrier means (101), and a toothed rack and gear means cooperating for adjusting said first carrier means along said intermediate connecting means.

8. The apparatus of claim 1, wherein said intermediate connecting means comprise two connecting members arranged in parallel to each other, to tilt together about said first horizontal axis (103).

* * * * *